US005402716A

United States Patent [19]

Holtom

[11] Patent Number: 5,402,716

[45] Date of Patent: Apr. 4, 1995

[54] REFUSE PACKER ASSEMBLY WITH DOUBLE ACTING RACK AND PINION DRIVE

[75] Inventor: Stephen W. Holtom, Greystanes, Australia

[73] Assignee: Matrik Pty. Ltd., West Perth, Australia

[21] Appl. No.: 842,160

[22] PCT Filed: Jul. 24, 1991

[86] PCT No.: PCT/AU91/00330

§ 371 Date: May 21, 1992

§ 102(e) Date: May 21, 1992

[87] PCT Pub. No.: WO92/01613

PCT Pub. Date: Feb. 6, 1992

[30] Foreign Application Priority Data

Jul. 24, 1990 [AU] Australia ..... PK 1362

[51] Int. Cl.[6] ..... B30B 1/24; B30B 7/00

[52] U.S. Cl. ..... 100/233; 100/256; 100/270; 100/288; 414/525.5

[58] Field of Search ..... 100/50, 100, 233, 256, 100/270, 271, 288; 414/525.2–525.51

[56] References Cited

U.S. PATENT DOCUMENTS

| | | | |
|---|---|---|---|
| 2,263,199 | 11/1941 | Wachter et al. | 414/525.5 |
| 3,134,321 | 5/1964 | Loehnert | 100/100 X |
| 3,220,577 | 11/1965 | Laverne | 100/233 X |
| 3,685,437 | 8/1972 | Panning | 100/256 X |

FOREIGN PATENT DOCUMENTS

| | | | |
|---|---|---|---|
| 0117939 | 9/1984 | European Pat. Off. | 414/525.5 |
| 0339360 | 11/1989 | European Pat. Off. | 414/525.51 |
| 1196122 | 11/1959 | France | 414/525.3 |
| 738395 | 8/1943 | Germany | 414/525.5 |
| 1946363 | 3/1971 | Germany | 100/233 |
| 2102379 | 2/1983 | United Kingdom . | |
| 2138386 | 10/1984 | United Kingdom | 414/525.2 |
| 506549 | 5/1976 | U.S.S.R. | 414/525.5 |

*Primary Examiner*—Stephen F. Gerrity
*Attorney, Agent, or Firm*—Larson and Taylor

[57] ABSTRACT

A refuse packer includes a paddle (14) which oscillates horizontally about axis (19) through about 200° to sweep refuse into a storage chamber of a vehicle (not shown). The paddle has an actuating assembly (26) supported by a single housing (27) secured to a vehicle chassis. The actuating assembly has a drive shaft with a hexagonal end clamped in a hexagonal opening (21) of the paddle. The drive shaft also has a pinion engaged by a pair of opposed toothed racks which slide in respective hydraulic cylinders (35, 36, 37, 38) which act to oscillate the shaft and paddle. A pair of hydraulic resistance cylinders (40) oppose side loads set up by the engagement of the racks with the pinion. In former arrangements the paddle was coupled to a crank plate moved by hydraulic rams which swung as they reciprocated. This led to uneven torque on the paddle and a tendency to stall midstroke, whereas the present drive provides even torque, throughout the oscillations.

16 Claims, 6 Drawing Sheets

18
23
25
24
46
45
48
53
41
43
47
44
49
42
52
50
37

REFUSE PACKER ASSEMBLY WITH DOUBLE ACTING RACK AND PINION DRIVE

FIELD OF INVENTION

The present invention relates to a refuse packer assembly.

More particularly, the invention relates to an assembly for packing refuse emptied from a bin into a larger refuse storage chamber. Preferably, the refuse packer assembly and refuse storage chamber are mounted on a refuse collection vehicle.

BACKGROUND ART

It is known to construct refuse packer assemblies of a type employing a paddle or blade adapted to be horizontally oscillatable through about 180° so as to sweep refuse from a collection bay to a larger refuse storage chamber mounted on a vehicle. The pivot axis of the paddle may be coupled to a crank plate having a pair of opposed crank arms and each of which are linked to hydraulic cylinders. The hydraulic cylinders are actuated in a synchronized angularly reciprocating manner so as to drive the paddle through its sweep.

However, these assemblies may generate a variable torque on the paddle as a result of the changing perpendicular distance between pivot axis and line of force applied by the cylinders during a paddle sweep, and this may be disadvantageous where a small torque is generated on the paddle but a higher torque is required to move a load.

Furthermore, the reciprocating cylinders may stall at mid stroke of the paddle where the ends of their piston strokes coincide and there is insufficient momentum to continue their angular travel. It is also disadvantageous that the cylinders are mounted externally of the paddle housing.

The complexity of cylinders and linkage means and the reliance placed upon their operation in effecting oscillation of the paddle has meant that prior art packer assemblies are difficult to maintain, heavy and prone to failure.

It is an object of the present invention to overcome or substantially ameliorate the disadvantages of the prior art.

DISCLOSURE OF THE INVENTION

According to the invention there is provided a refuse packer assembly for sweeping refuse from a loading bay to a storage chamber, comprising a paddle located within said loading bay, a shaft rotatably supporting said paddle, said shaft including pinion means, first and second rack means adapted to meshingly engage said pinion means at opposite sides thereof, and power means for oscillatably driving each of the rack means with oppositely directed strokes, whereby the first and second rack means co-operate with the pinion means to rotatably oscillate the paddle about the shaft and sweep refuse to the storage chamber.

Preferably, the paddle is dished at both sides thereof.

Preferably, the shaft, the first and second rack means and the power means are mounted on a shared mounting.

Preferably, the power means are driven by hydraulic fluid circulating in a hydraulic circuit.

Preferably, the hydraulic fluid drives opposed hydraulic cylinders, operable so that the opposed cylinders oscillatably drive the rack means.

Preferably, each of the rack means of the refuse packer assembly is laterally engaged against a resistance cylinder adapted to oppose the side load exerted on the rack means by its meshing engagement with the pinion means.

Preferably, the ends of sweep stroke of the paddle are set by a pair of limit switches disposed in the loading bay.

Preferably, the limit switches are disposed so that the paddle is rotatably oscillatable about 200°.

Preferably, a threshold pressure sensor is located in the hydraulic circuit so as to sense an immoveable load in the loading bay and cause the limit switch operation to be overridden.

BRIEF DESCRIPTION OF THE DRAWINGS

In order that the invention may be more readily understood and put into practical effect, reference will now be made to the accompanying drawings, in which.

DESCRIPTION OF PREFERRED EMBODIMENT

Figure 1:
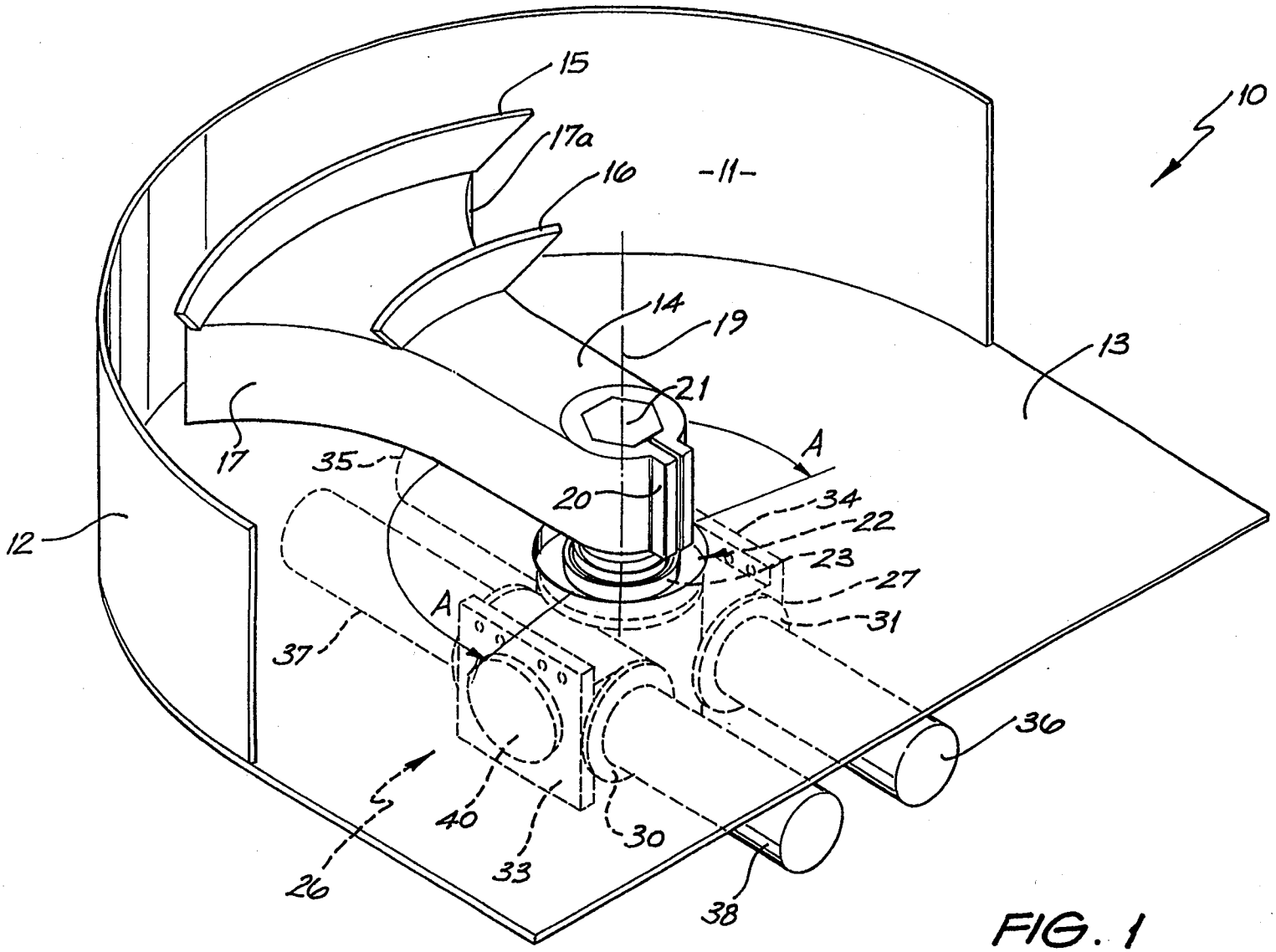
FIG. 1 shows a preferred refuse packer assembly.

The refuse packer assembly 10 of FIG. 1 includes a refuse receiving bay 11 defined by a semicircular wall 12 and the floor 13 surrounded thereby, into which refuse from a bin may be emptied. There is a paddle 14 which is adapted to horizontally oscillate about axis 19 through about 200° (as shown by arrows A) and sweep the refuse into a refuse storage chamber of a vehicle (not shown).

The paddle 14 includes a pair of cutting blades 15 and 16 adapted to break open or tear sealed plastic bags and the like that might otherwise be difficult to sweep. The outer edge of the paddle 14 is semicircular and so follows the contour of the bay wall 12. The opposed sides or sweep faces 17 and **17*a* of the paddle 14 are dished so that the tendency for refuse to accumulate along the wall 12**, such as when being swept by a flat sweep face, is avoided.

At the end of the paddle 14 furthest from the wall 12, the paddle 14 is split to form two opposed abutment walls 20 and define a hexagonal aperture 21. The aperture 21 encloses a hexagonal portion 25 of a pivotal shaft 18 (shown in detail in FIG. 2) for the paddle 14.

Although not abutting against each other in this instance, the abutment walls 20 are, nevertheless, bolted securely to each other and clamp the paddle 14 around the hexagonal portion 25 of the shaft 18.

Figure 2:
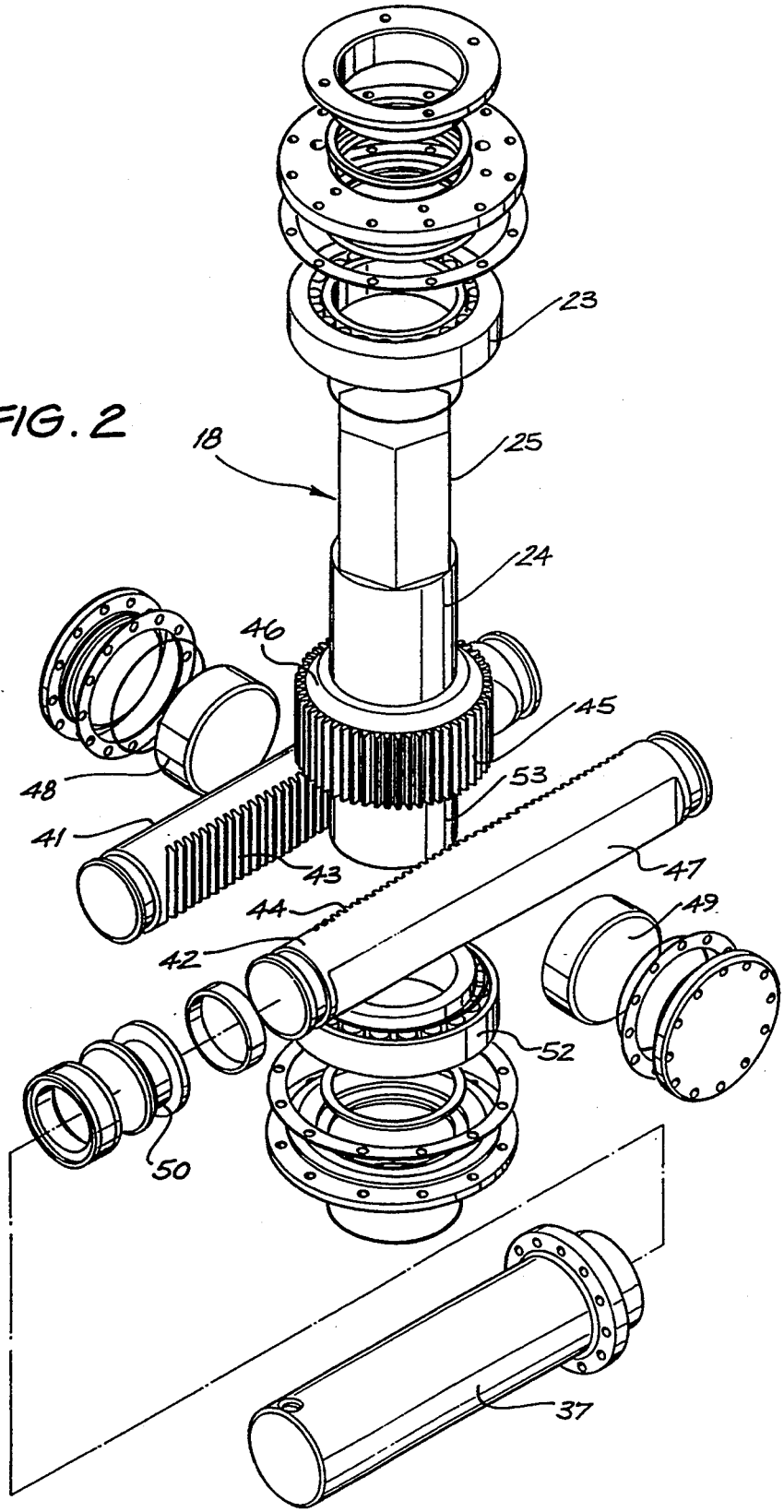
FIG. 2 shows an exploded view of a portion of the actuating assembly for the packer assembly of FIG. 1.

In FIG. 1, a portion of the floor 13 nearest the shaft 18 has been removed to show part of the shaft supporting structure 22 underneath. The structure 22 includes an annular bearing 23 surrounding an upper cylindrical portion 24 of the shaft 18 (cylindrical shaft portion 24 is shown in FIG. 2). FIG. 2 also shows an annular bearing 52 that is adapted to surround a lower cylindrical portion 53 of the shaft 18.

Figure 3:
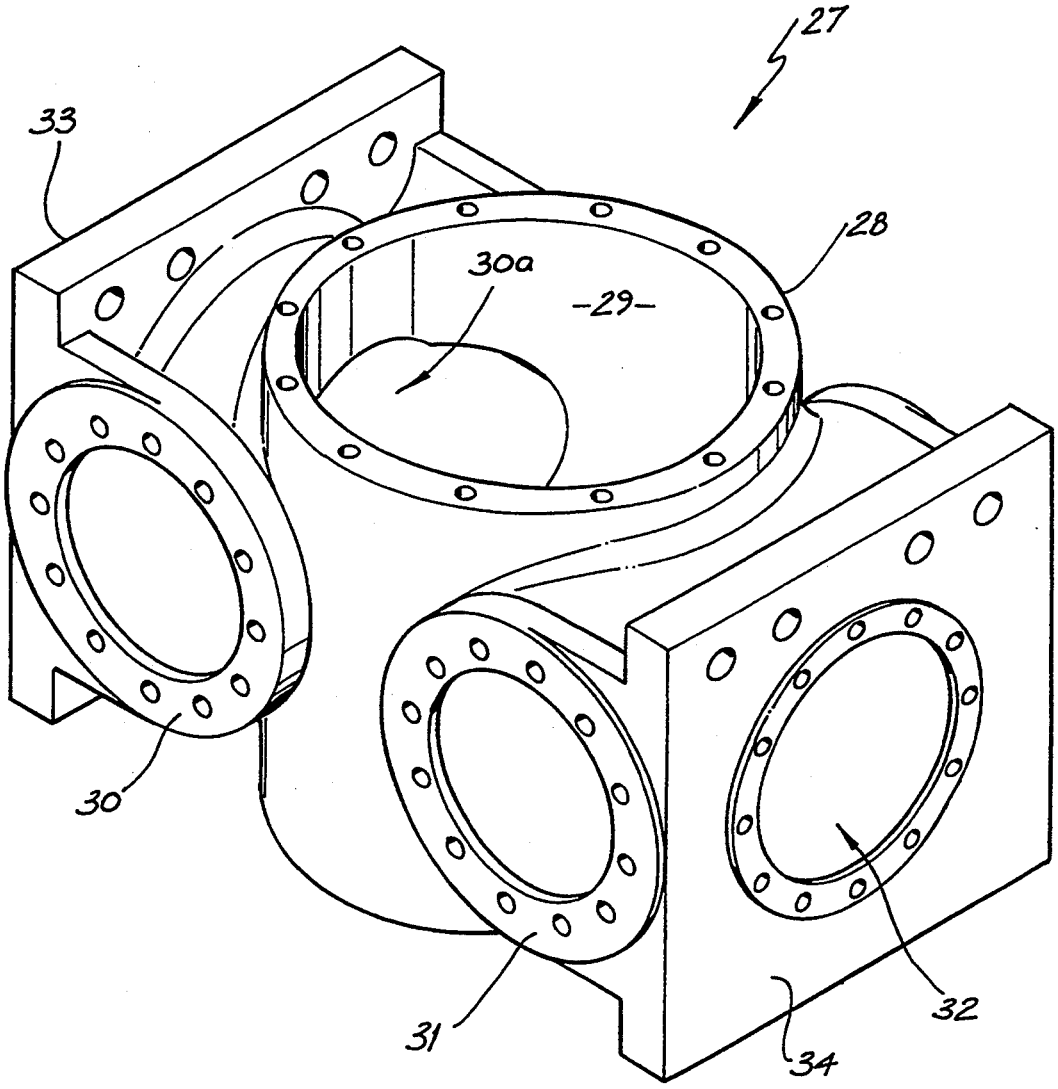
FIG. 3 shows a mounting for the actuating assembly of the packer assembly of FIG. 1.
Figure 4:
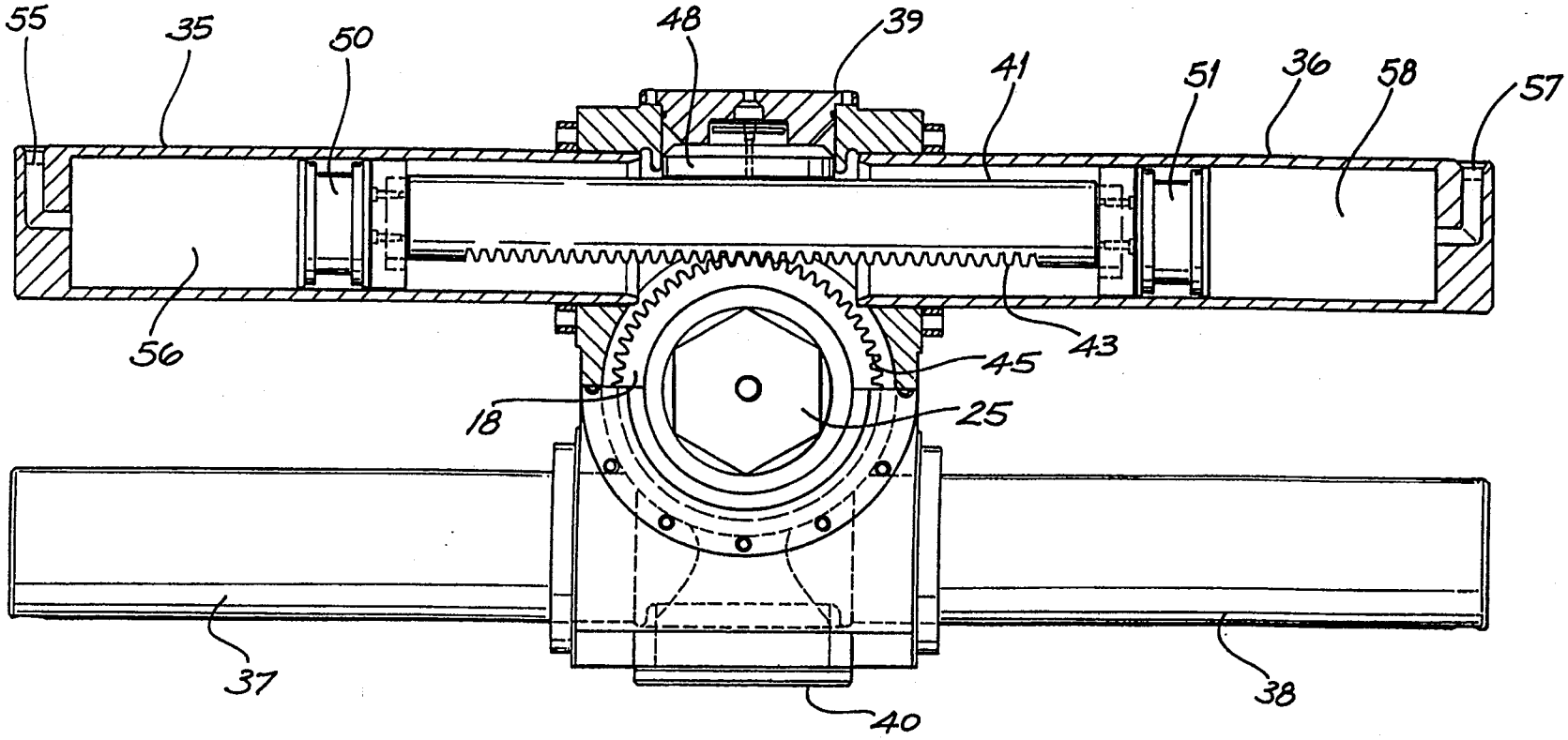
FIG. 4 shows a partially cut away top view showing internal detail of the actuating assembly for the packer assembly of FIG. 1.
Figure 5:
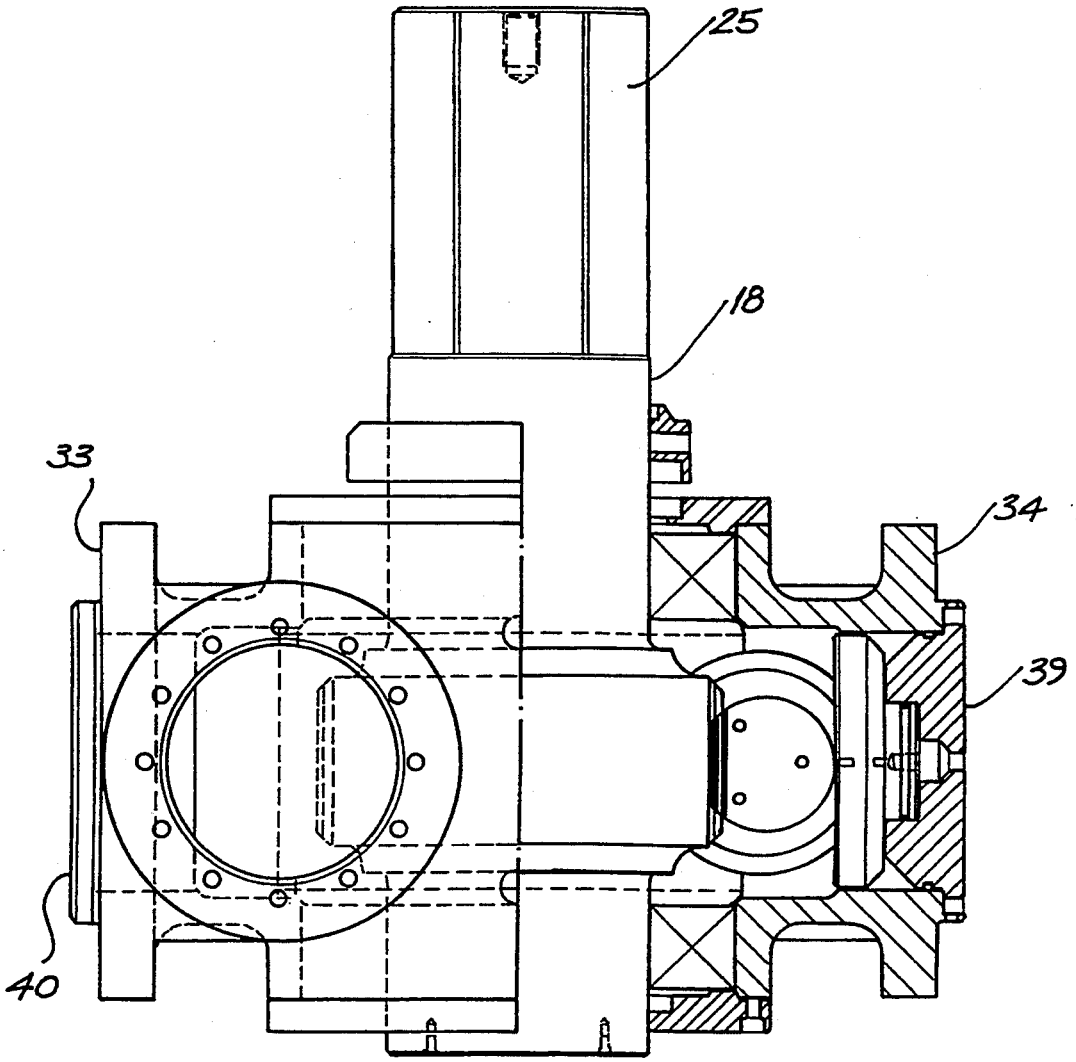
FIG. 5 shows a partially cut away end view showing internal detail of the actuating assembly of FIG. 4, and FIG. 6 schematically shows a hydraulic circuit diagram that controls the operation of the packer assembly of FIGS. 1 to 5.

Located beneath the floor 13 and shown in dotted outline in FIG. 1 is the paddle actuating assembly 26. The housing 27 for the assembly 26 is shown in FIG. 3. Internal detail of the paddle actuating assembly 26 is shown in FIGS. 2, 4 and 5. The housing 27 is mounted securely to the chassis of the vehicle (now shown).

The housing 27 shown in FIG. 3 includes a central cylinder wall 28 defining a hollow cylindrical bore 29 therewithin and into which an actuating portion of the shaft 18 (shown in FIG. 2) is adapted to be located (to be described in detail later).

On opposite sides of the cylinder wall 28 are a pair of hollow bore cylindrical drums 30 and 31 having longitudinal axes lying transversely to the longitudinal axis of the cylinder wall 28. Within each drum 30 and 31, a drive means is adapted to be located (to be described in detail later). The bore of the hollow drums 30 and 31 communicate with the bore 29 of the central cylinder wall 28 via openings (only opening 30*a* shown in FIG. 3, but the openings are shown in detail in FIGS. 4 and 5) and this enables the actuating portion of the shaft 18 to engage the drive means.

Each of the drums 30 and 31 also have cylindrical apertures (only aperture 32 shown in FIG. 3) exposing their bore at both planar end surfaces 33 and 34 of the housing 27.

Referring to FIG. 1, mounted securely within each hollow bore cylindrical drum 30 and 31 are a pair of opposed hydraulic cylinders. Drum 30 supports cylinder 37 and cylinder 38. Drum 31 supports cylinder 35 and 36.

Mounted securely within each cylindrical aperture (only aperture 32 shown in FIG. 3) of end surfaces 33 and 34 are hydraulic resistance cylinders 39 and 40 shown in FIGS. 1, 4 and 5. These resistance cylinders 39 and 40 are adapted to oppose the side load exerted on the drive means during its engagement with the actuating portion of the shaft 18.

The structure and co-operation of the drive cylinders 35, 36, 37 and 38, the drive means contained within the drums 30 and 31, the actuating portion of the shaft 18 and the resistance cylinders 39 and 40 will be described with reference to FIGS. 2, 4 and 5.

Shown in the exploded FIG. 2 are a pair of racks 41 and 42 (the earlier mentioned drive means). The racks 41 and 42 are identical and have teeth 43 and 44 respectively. The teeth 43 and 44 are adapted to meshingly engage with teeth 45 (the earlier mentioned actuating portion of the shaft) supported about a boss 46 of the shaft 18. The shaft 18 therefore serves as a pinion that may be turned by mutually reciprocating sliding movement of the engaging racks 41 and 42. Hereinafter, the shaft 18 will be referred to as the pinion 18 for ease of description.

Each rack 41 and 42 has a flat surface (only flat surface 47 of rack 42 shown) machined along nearly its total length on the opposite side to its teeth. Pistons 48 and 49 of resistance cylinders 39 and 40 are adapted to abut against their respective rack flat surface and so provide a counter pressure against the rack which, in slidably turning the pinion 18 will experience a back pressure brought about by the meshing engagement of teeth.

As shown in FIG. 4, the opposite end portions of rack 41 are slidably contained within their respective cylinders 35 and 36. Both of the opposed cylinder assemblies shown in FIG. 4 are identical, and so, for ease of reference, the specification will describe the opposed cylinder assembly shown in internal detail in FIG. 4.

Cylinder 35 has a piston 50 that abuts against one end of the rack 41. (The identical piston of cylinder 37 shown in FIG. 2 is also identified by numeral 50). As mentioned earlier, the rack 41 has teeth 43 which meshingly engage with the teeth 45 of the pinion 18. The rack 41 has its other end abut against a piston 51 contained in cylinder 36.

In order to turn the pinion 18 (and therefore turn the pinion connected paddle 14), hydraulic fluid is introduced via port 55 into the bore 56 of the cylinder 35, thereby exerting pressure against the piston 50 and causing it to push against the rack 41. The rack 41 will slide to the right as shown in FIG. 4 and the meshing engagement of its teeth 43 with the teeth 45 of the pinion 18 will cause the pinion 18 to turn about its axis in a clockwise direction.

As the rack 41 is sliding to the right, it pushes against piston 51 in cylinder 36 and causes hydraulic fluid to escape therefrom via port 57.

A limit switch (to be described later with reference to FIG. 6) will determine the end of the stroke of the piston 50 in cylinder 35, and this will correspond to one extremity of the sweep experienced by the paddle 14.

Once the end of the piston stroke or paddle sweep is sensed, hydraulic fluid is then introduced via port 57 into the bore 58 of cylinder 36, thereby exerting pressure against the piston 51 and causing it to push against the rack 41. The rack 41 will slide to the left as shown in FIG. 4 and the meshing engagement of its teeth 43 with the teeth 45 of the pinion 18 will cause the pinion 18 to turn about its axis in an anticlockwise direction.

As the rack 41 is sliding to the left, it pushes against piston 50 in cylinder 35 and causes hydraulic fluid to escape therefrom via port 55.

Another limit switch (refer to FIG. 6) will determine the end of the stroke of the piston 51 in cylinder 36, and this will correspond to the other extremity of the sweep experienced by the paddle 14.

This operation is repeated for as long as it is desired to oscillate the paddle 14.

Although not shown in FIG. 4, the identical opposed cylinder assembly consisting of cylinders 37 and 38 has its rack move in the opposite direction simultaneously with the rack 41 and so provides the same tangential force against the pinion 18. This has the effect of providing a doubled force to the paddle 14.

Furthermore, the equal displacement cylinder operation ensures that the speed, force and torque of the paddle 14 remain constant throughout the sweeping motion and in both directions of sweep. It is noteworthy that, for each of the racks 41 and 42, the product of the force exerted by the rack and the perpendicular distance between the line of force and the axis of the pinion 18 is constant throughout each stroke. The constant force on the paddle 14 throughout its stroke ensures that, unlike some prior art, the paddle is not prone to stall at mid stroke.

Also unlike conventional prior art systems, the paddle 14 is only ever turned as a result of pushing forces, rather than pulling forces, and the available surface area against which hydraulic pressure is applied is constant.

Figure 6:
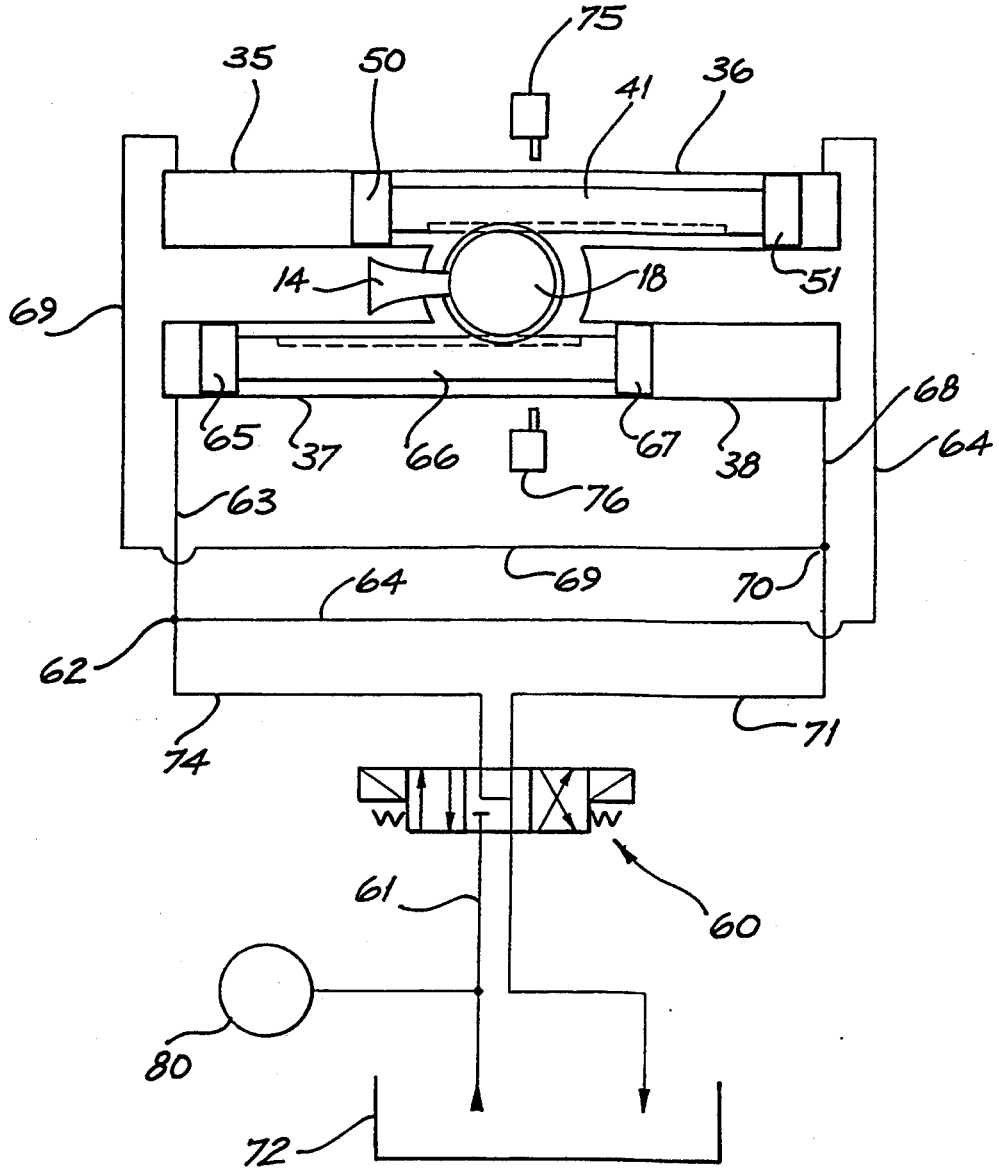

FIG. 6 is a schematic diagram of the hydraulic circuit and valve system that operates the packer apparatus 10.

The valve orientation shown represents an end of sweep or otherwise stationary position of the paddle 14.

In order to turn the paddle 14 as shown in FIG. 6 in an anticlockwise direction, the packer on-off valve 60 is energized causing the valve to assume a position corresponding to the parallel opposed arrow orientation as shown. In this orientation, hydraulic fluid is fed from a tank 72 through delivery line 61, past valve 60 and into line 74 and has its flow then divided at junction 62 into lines 63 and 64. Line 63 feeds hydraulic fluid into the end of cylinder 37 whilst line 64 feeds hydraulic fluid into the end of cylinder 36. The pressure of the hydraulic fluid at each cylinder end causes pistons 65 and 51 to push the racks 66 and 41 respectively in opposite directions and their meshing engagement with the teeth of the pinion 18 causes the paddle 14 to turn in an anticlockwise direction as shown in FIG. 6 until the end of its stroke, thereby sweeping refuse from the refuse receiving bay 11.

The racks 66 and 41 also push against pistons 67 and 50 respectively and force hydraulic fluid to be released from opposed cylinders through lines 68 and 69 respectively. Released hydraulic fluid feeds to a joining junction 70 and travels through line 71, via valve 60, back to tank 72.

In order to turn the paddle 14 in a clockwise direction as shown in FIG. 6, the packer on-off valve 60 is energized causing the valve to assume a position corresponding to the criss-crossed arrow orientation as shown. In this orientation, hydraulic fluid is fed from tank 72 through delivery line 61, past valve 60 into line 71 and has its flow then divided at junction 70 into lines 68 and 69. Line 68 feeds hydraulic fluid into the end of cylinder 38 whilst line 69 feeds hydraulic fluid into the end of cylinder 35. The pressure of the hydraulic fluid at each cylinder end causes pistons 67 and 50 to push the racks 66 and 41 respectively in opposite directions and their meshing engagement with the teeth of the pinion 18 causes the paddle 14 to turn in a clockwise direction as shown in FIG. 6 until the end of its stroke, thereby sweeping refuse from the refuse receiving bay 11.

The racks 66 and 41 also push against pistons 65 and 51 respectively and force hydraulic fluid to be released from opposed cylinders through lines 63 and 64 respectively. Released hydraulic fluid feeds to a joining junction 62 and travels through line 74, via valve 60, back to tank 72.

There is an on-off supply of power to actuate the packer assembly 10 and when the power is on, the driver of any vehicle upon which the packer assembly is mount, need not manipulate any controls to effect continuous oscillatory movement of the paddle 14, as this will be controlled automatically from the power source of the vehicle.

A pair of limit switches 75 and 76 ensure that the extent of the paddle sweep is slightly less than would be the case if the paddle 14 where to be driven only by the available stroke of the drive pistons in the packer assembly.

There is a pressure sensor 80 located on delivery line 61. If hydraulic fluid back pressure in line 61 passes a threshold value, such as when the paddle 14 meets an immoveable load in mid sweep, an alarm may sound and the operator may activate a release mechanism (not shown) that will override the limit switches 75 and 76 that normally will initiate a reversal of the stroke.

Various modifications may be made in details of design and construction without departing from the scope or ambit of the invention.

I claim:

1. A refuse packer assembly for sweeping refuse from a loading bay to a storage chamber, the assembly comprising:

a paddle located within said loading bay for sweeping refuse from the loading bay to the storage chamber;

a shaft pivotably supporting said paddle for pivoting movement about a pivot axis, said shaft being provided with a coaxially mounted gear wheel in connection therewith;

a first elongate rack adapted to mesh with one side of said gear wheel and a second elongate rack adapted to mesh with an opposite side of said gear wheel;

first and second load resistance cylinders having first and second pistons respectively provided to laterally engage the first and second racks respectively and to oppose side loads exerted on the first and second racks respectively by the meshing of the first and second racks with the gear wheel; and, a driving means for oscillatably driving both the first and second racks with oppositely directed strokes whereby, in use, the first and second racks cooperate with the gear wheel to pivotably oscillate the paddle about the pivot axis and sweep refuse to the storage chamber.

2. A refuse packer assembly as claimed in claim 1, wherein each rack is provided with teeth along substantially its length on one side thereof and a planar surface along substantially its length on the opposite side to said teeth, and wherein said first and second pistons of the respective first and second load resistance cylinders are adapted to abut against the respective planar surfaces of the first and second racks.

3. A refuse packer assembly as claimed in claim 1, wherein said loading bay has a semicircular wall having an inner diameter that is slightly larger than an outer diameter of a sweep path defined by the paddle during pivoting movement about said pivot axis, and wherein said paddle is dished on both sides thereof to form concave opposed sweep faces of the paddle whereby, in use, during pivoting movement of the paddle the tendency of refuse to accumulate along the wall of the loading bay is substantially avoided.

4. A refuse packer assembly as claimed in claim 1, wherein said driving means comprises two pairs of opposed hydraulic drive cylinders, each pair of opposed drive cylinders having slidably received therein one of said first and second racks and being operable to oscillatably drive said racks.

5. A refuse packer assembly as claimed in claim 4, wherein said two pairs of opposed drive cylinders, said gear wheel and said first and second load resisting cylinders are all mounted in a common housing.

6. A refuse packer assembly as claimed in claim 1, wherein a first switch is provided to determine the extent of pivoting movement of the paddle in one direction, and a second switch is provided to determine the extent of pivoting movement of the paddle in opposite direction whereby, in use, each end of a sweep stroke of the paddle is set by the first and second switches.

7. A refuse packer assembly as claimed in claim 6, wherein the first and second switches are disposed so that said paddle is pivotably oscillatable about said pivot axis through an angle of 200°.

8. A refuse packer assembly as claimed in claim 7, wherein said first and second switches are adapted to operatively control said driving means whereby, in use, said paddle automatically changes direction at each end of the sweep stroke.

9. A refuse packer assembly for sweeping refuse from a loading bay to a storage chamber, the assembly comprising:

a paddle located within said loading bay for sweeping refuse from the loading bay to the storage chambers;

a shaft pivotably supporting said paddle for pivoting movement about a pivot axis, said shaft being provided with a coaxially mounted gear wheel in connection therewith;

a first elongate rack adapted to mesh with one side of said gear wheel and a second elongate rack adapted to mesh with an opposite side of said gear wheel;

first and second load resisting means provided to laterally engage the first and second racks respectively, and adapted, in use, to oppose side loads exerted on the first and second racks respectively by the meshing of the first and second racks with the gear wheel;

a driving means for oscillatably driving both the first and second racks with oppositely directed strokes whereby, in use, the first and second racks cooperate with the gear wheel to pivotably oscillate the paddle about the pivot axis and sweep refuse to the storage chamber; and, wherein said loading bay has a semicircular wall having an inner diameter that is slightly larger than an outer diameter of a sweep path defined by the paddle during pivoting movement about said pivot axis, and wherein said paddle is dished on both sides thereof to form concave opposed sweep faces of the paddle whereby, in use, during pivoting movement of the paddle the tendency of refuse to accumulate along the wall of the loading bay is substantially avoided.

10. A refuse packer assembly as claimed in claim 9, wherein each rack is provided with teeth along substantially its length on one side thereof and a planar surface along substantially its length on the opposite side to said teeth, wherein said first and second load resisting means are adapted to abut against the respective planar surfaces of the first and second racks.

11. A refuse packer assembly as claimed in claim 10, wherein said first and second load resisting means comprise first and second resistance cylinders having first and second pistons adapted to laterally engage the first and second racks respectively.

12. A refuse packer assembly as claimed in claim 9, wherein said driving means comprises two pairs of opposed hydraulic drive cylinders, each pair of opposed drive cylinders having slidably received therein one of said first and second racks and being operable to oscillatably drive said racks.

13. A refuse packer assembly as claimed in claim 12, wherein said two pairs of opposed drive cylinders, said gear wheel and said first and second load resisting means are all mounted in a common housing.

14. A refuse packer assembly as claimed in claim 9, wherein a first switch is provided to determine the extent of pivoting movement of the paddle in one direction, and a second switch is provided to determine the extent of pivoting movement of the paddle in the opposite direction whereby, in use, each end of a sweep stroke of the paddle is set by the first and second switches.

15. A refuse packer assembly as claimed in claim 14, wherein the first and second switches are disposed so that said paddle is pivotably oscillatable about said pivot axis through an angle of 200°.

16. A refuse packer assembly as claimed in claim 15, wherein said first and second switches are adapted to operatively control said driving means whereby, in use, said paddle automatically changes direction at each end of the sweep stroke.

* * * * *